US005487466A

United States Patent [19]

Robson

[11] Patent Number: 5,487,466

[45] Date of Patent: Jan. 30, 1996

[54] DESKTOP ACCESSORIES HOLDER

[76] Inventor: Jerry A. Robson, 50 Maple La., Mansfield, Ohio 44906

[21] Appl. No.: 311,719

[22] Filed: Sep. 23, 1994

Related U.S. Application Data

[63] Continuation of Ser. No. 101,470, Aug. 2, 1993, abandoned.

[51] Int. Cl.[6] ..... A45C 11/34; B65D 85/28

[52] U.S. Cl. ..... 206/214; 206/371; 206/805

[58] Field of Search ..... 206/214, 320, 206/371, 224, 805, 362, 364, 372, 373; 220/735

[56] References Cited

U.S. PATENT DOCUMENTS

| | | | |
|---|---|---|---|
| 191,331 | 5/1877 | Forman | 211/69.9 |
| 230,894 | 8/1880 | Pope | 211/65 |
| 531,065 | 12/1894 | Rubin | 206/214 X |
| 540,268 | 6/1895 | Newell | 206/371 |
| 764,795 | 7/1904 | Collins | 132/289 |
| 1,369,439 | 2/1921 | Johnson | 206/224 X |
| 2,193,727 | 3/1940 | Jouffray | 211/69.8 |
| 2,202,300 | 5/1940 | Posnack | 211/69.1 X |
| 2,594,176 | 4/1952 | Kaiser, Jr. | 220/735 X |
| 2,929,511 | 3/1960 | Josephson | 211/60.1 |
| 2,945,251 | 7/1960 | Eichner | 206/362 X |
| 2,987,194 | 6/1961 | Burge | 211/65 X |
| 3,187,723 | 6/1965 | Kihara | 206/214 |
| 3,407,429 | 10/1968 | Di Nardo | 220/735 X |
| 3,502,224 | 3/1970 | Heinze | 211/69.8 |
| 3,700,097 | 10/1972 | Thomas | 206/583 |
| 4,034,926 | 7/1977 | Wegner | 206/805 X |
| 4,044,980 | 8/1977 | Cummins | 206/371 X |
| 4,066,171 | 1/1978 | Fowlie | 211/69.1 |
| 4,176,743 | 12/1979 | Fitzpatrick | 206/214 |
| 4,286,717 | 9/1981 | Liesinger | 211/89 X |
| 4,320,835 | 3/1982 | Polhemus et al. | 206/214 X |
| 4,384,647 | 5/1983 | Schweizer | 206/214 X |
| 4,494,660 | 1/1985 | Hansen | 211/69.1 |
| 4,850,512 | 7/1989 | Vujovich | 206/359 X |
| 4,991,712 | 2/1991 | Wagner | 206/214 |
| 5,265,735 | 11/1993 | Hassel et al. | 206/214 X |

FOREIGN PATENT DOCUMENTS

| | | | |
|---|---|---|---|
| 0256719 | 2/1988 | European Pat. Off. | 206/214 |
| 0870122 | 12/1941 | France | 206/805 |
| 0271732 | 6/1927 | United Kingdom | 206/805 |

*Primary Examiner*—Jacob K. Ackun
*Assistant Examiner*—Ted Kavanaugh
*Attorney, Agent, or Firm*—Lee, Mann, Smith, McWilliams, Sweeney & Ohlson

[57] ABSTRACT

An improved desktop accessories holder is disclosed which incorporates a platform resting on a horizontal surface such as a desktop, and slanting upwardly on an incline as it extends away from a user. A pencil cup is held on the inclined platform so that the open end of the pencil cup faces the user, and pocket members are hung onto the sides of the pencil cup to provide containers for paper clips, typing correction fluid, stamps and the like which a user can readily reach into because the tops of the containers are tilted toward and face the user in the same manner as the open end of the pencil cup. Adjacent the top of the pencil cup is a mesh of rubber bands which elastically grasp the bodies of the items which are pushed into the pencil cup.

12 Claims, 3 Drawing Sheets

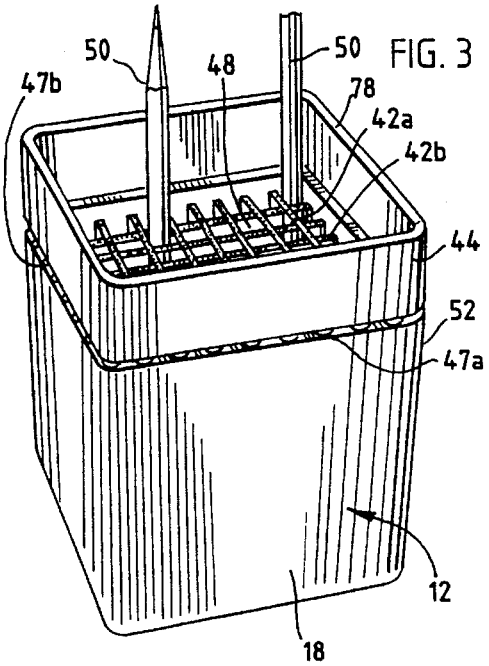
FIG. 3
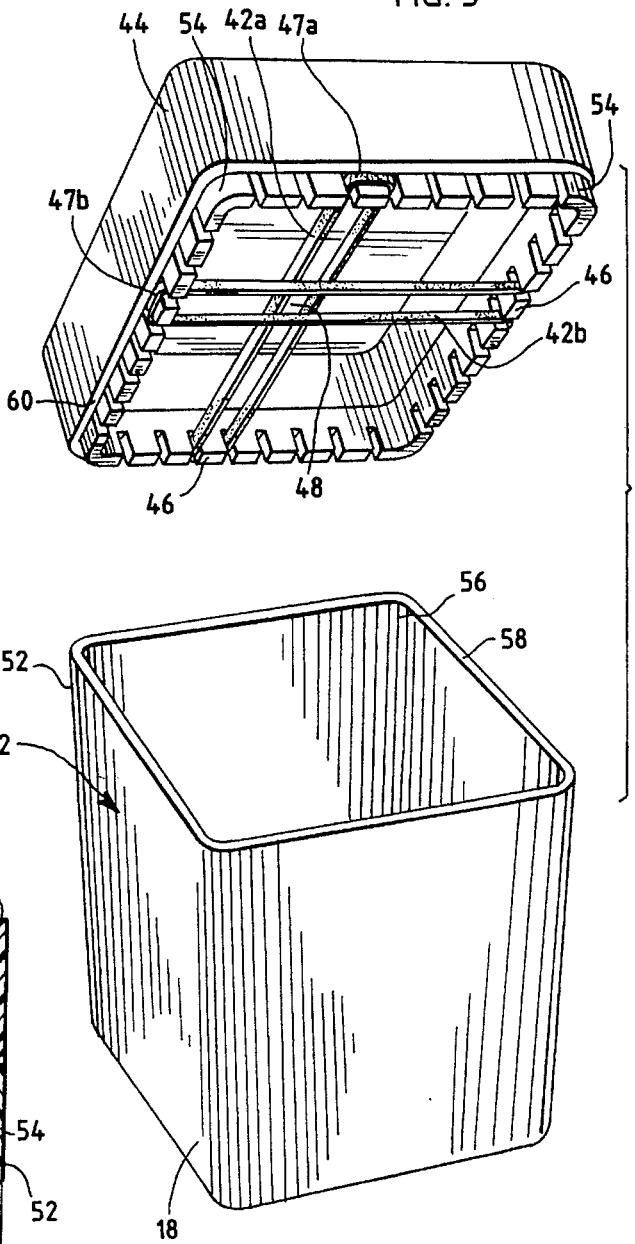
FIG. 5
FIG. 4
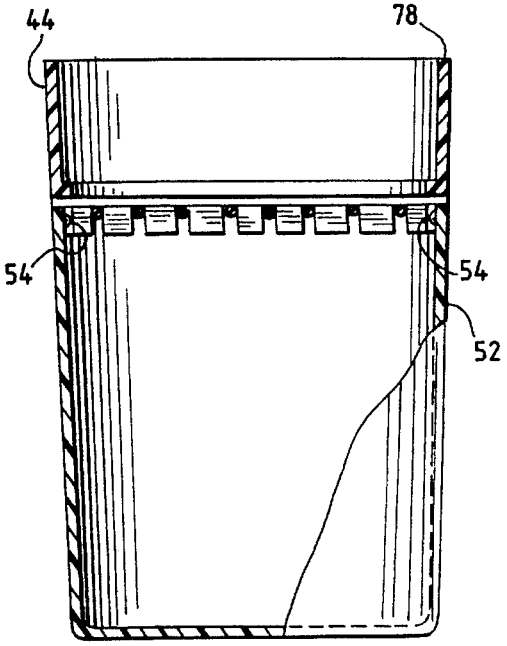

DESKTOP ACCESSORIES HOLDER

This application is a continuation of application Ser. No. 08/101,470, filed Aug. 2, 1993, now abandoned.

This invention relates to desktop caddies for holding office supplies such as pencils, paper clips, stamps, correction fluid bottles, and the like in a convenient manner for an office worker to pick up. More particularly, it relates to a pencil cup held at an angle by an enclosed platform base, with pocket members hung onto the side of the pencil cup to form a desktop caddy for collecting and dispensing a variety of office supplies.

A variety of United States patents address this or similar subjects, including Des. 326,113 (May 12, 1992); Des. 325,934 (May 5, 1992); Des. 266,772 (Nov. 2, 1992); U.S. Pat. No. 4,494,660 (Jan. 22, 1985); U.S. Pat. No. 2,193,727 (Mar. 12, 1940) and U.S. Pat. No. 1,491,926 (Apr. 29, 1924). The '660 and '727 patents concern metal web assemblies for holding pencils; these assemblies have at least two layers of wire web which engage a pencil at well-spaced apart points along the body of the pencil.

One object of the present invention is to provide a desktop accessories holder for storing a variety of office supplies, including pencils, pens, and the like in a convenient stand.

Another object of this invention is to provide a pencil cup member in a desktop accessories holder disposed at an angle to the top of the desk to present an upwardly facing open cup end which is slanted toward the user.

Another object of this invention is to provide a pencil cup member which includes a mesh of rubber bands stretched across the upper open end of the cup for gripping round, slender objects such as pencil bodies or the barrels of pens and hold them in the cup when it is accidentally tipped over.

Another object of this invention is to provide a pencil cup with a mesh of rubber bands near its upper, open end engaged upon teeth in the cup wall which can be readily exposed for replacement of the rubber bands by an ordinary user whenever replacement is needed.

Another object of this invention is to provide a pencil cup with a collar around its upper, open end and either having depending teeth on the collar for engaging the looped ends of rubber bands which form a mesh across the open end of the cup, or a collar lower edge portion surrounding and nestable upon teeth extending upwardly from the upper edges of the cup which hold the rubber bands.

Another object of this invention is to provide an office supplies holder for a desktop which is readily separable by the user into component containers for sortable items such as paper clips, stamps, note pads, and pencil holder, and readily reassemblable by the user.

Additional objects and features of the invention will be apparent from the following description in which the preferred embodiments are set forth in detail in conjunction with the accompanying drawings as follows:

FIG. 3 is a perspective view of the pencil cup component of FIG. 1, with pencils shown in position in the cup;

FIG. 4 is a partially cut away view of the pencil cup component of FIG. 3;

FIG. 5 is an exploded perspective view of the pencil cup component of FIG. 3 with a portion of the mesh element in the upper portion of the cup removed.

DESCRIPTION OF THE PREFERRED EMBODIMENTS

Figure 1:
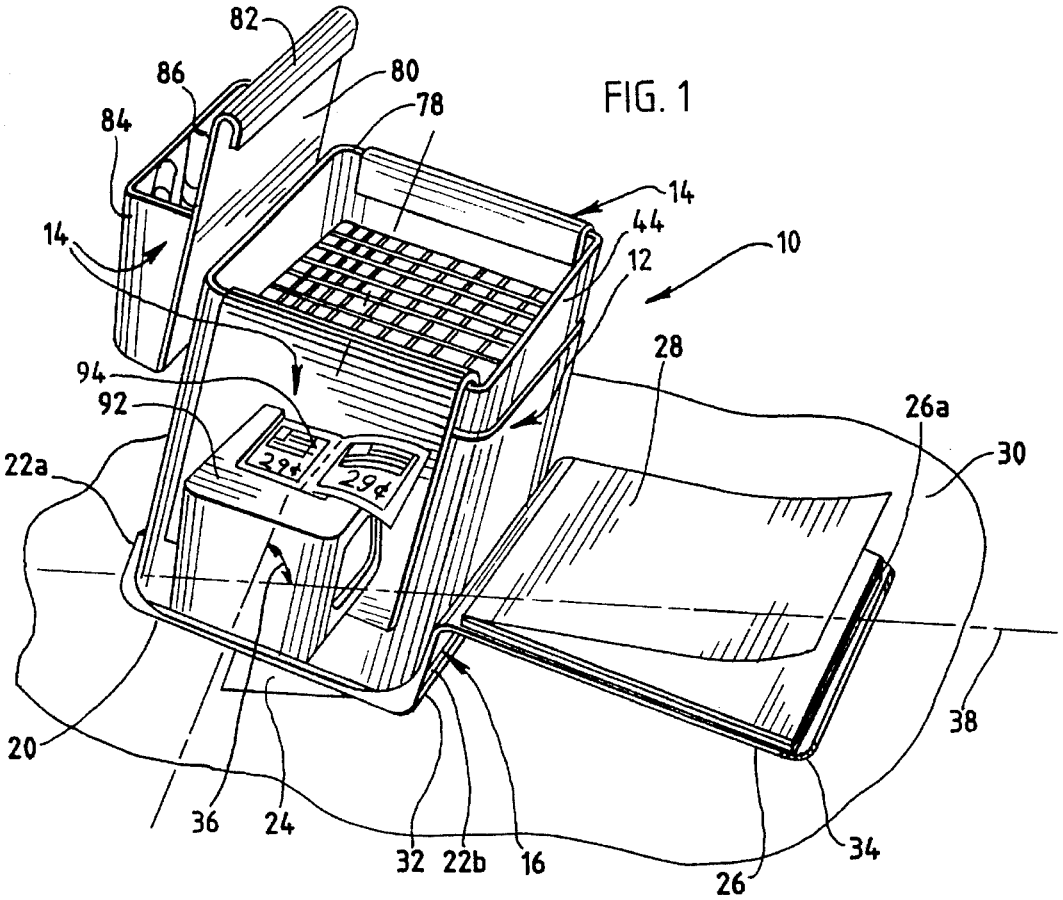
FIG. 1 is a frontal perspective view of the desktop accessories holder of this invention, partially exploded to show one of the hanging components poised for assembly on the rear side of the pencil cup component.

The desktop accessories holder 10 of this invention includes a pencil cup member 12, one or more hanger members 14 and a platform member 16, as shown in FIG. 1. A lower, closed end portion 18 of the pencil cup is adapted to nest in and be supported upon a first planar section 20 of the platform member 16 between upwardly extending edge members **22*a* and 22*b* formed near the ends of the first planar section in the platform 16. A small, wedge-shaped foot 24 may be attached to the underside of the platform 16**, opposite the top or deck side of the platform on which the lower end of the pencil cup rests.

The platform also includes a second planar section 26 extending outwardly from one of the edge members, such as **22*b*, and forming a flat surface for a memo pad such as 28. The memo pad may be affixed with an adhesive backing to the second planar section or a cleat 26*a* may be formed near the end of the section to stop the pad from sliding off. The wedge-shaped foot 24 beneath the platform member supports the platform at a slight incline from the horizontal, such as would be presented by a desktop surface 30, partially shown in FIGS. 1 and 2**.

The platform member 26 may have a pair of pronounced planar sections such as 20 and 26, and the edge members **22*a* and 22*b* for containing the lower closed end portion of the pencil cup, may also be pronounced, as shown. The disposition of the wedge-shaped foot 24 under one end of the platform may be arranged to cooperate with a corner 32 formed by the junction of the first planar section 20 with the edge member 22*b*, and also with the undersurface of the end 34 of the second planar section 26, to provide a plurality of resting points for the platform on the desk surface 30**. However, the edge members for holding the lower end portion of the pencil cup may be shorter and less pronounced and the difference between the first and second planar sections less distinct and still afford a base to hold the pencil cup, as well as the note pad, in a tilted attitude facing a person seated at the desk.

Thus, the edge members **22*a* and 22*b* are inclined at an acute angle 36 to a horizontal plane through the platform, such as represented by dotted line 38 parallel to the desktop 30, and the vertical axis 40 of the pencil cup, when its lower end portion is engaged by the edge members, is directed similarly with respect to the horizontal plane represented by line 38**.

The pencil cup member 12, as more particularly shown in FIGS. 3, 4 and 5, includes a mesh of rubber bands **42*a* and 42*b*. A collar portion 44 of the cup member 12 is provided with depending teeth 46 which may be dimensioned to nest into the top end of the body portion 52 of the pencil cup. The rubber bands 42*a* and 42*b* are stretched between the teeth 46 with the looped ends of the rubber bands being slipped upon the teeth. Preferably, one layer of the rubber bands 42*a* is stretched in a direction which is normal to, and also closely adjacent to, a second layer of rubber bands 42*b*. The interstices 48 of the mesh thus formed by the layers are somewhat smaller than the pencils such as 50** which are expected to be held, but the boundaries of the interstices are very flexible, the rubber bands tending to mold themselves around the contours of objects inserted into the mesh. There is also a substantial adherence of the rubber bands to the objects in the mesh, and great flexibility for accepting a variety of sizes of items such as pencil bodies, plastic pen barrels and even scissors, spoons and clips disposed in adjacent interstitial spaces.

Collar 44 may be removably affixed to the body portion 52 of the pencil cup member 12, either in a friction fit between the outer surfaces of teeth 46 and the walls of the body portion adjacent their junction with the collar 44, or in a more permanent connection such as by cementing some or all of the teeth of the collar portion to the body portion (not shown). Alternatively, a small button, such as 54, may be formed on the outside of some of the teeth and arranged to be snapped into cooperatively sized indentations, such as 56, inside the body portion 52. In this way, if a rubber band should happen to break, or become slack, the collar 44 can be separated from the body portion and the broken or slack rubber band replaced or restrung. When the teeth 46 on the collar 44 are nested inside the body portion 52 of the cup, the teeth will be within the cup and the segments 47*a* and 47*b* of the rubber bands which are looped around the teeth will extend beyond them and overlie the rim 58 of the body portion 52 of the cup. If the collar portion 44 is constructed with an outwardly extending shoulder 60 adjacent the roots of the teeth which will overlie the rim 58 of the cup's body portion, as shown in FIG. 5, for example, the looped segments 47*a* and 47*b* of the rubber bands are further engaged between the shoulder 60 and the rim 58 when the collar portion 44 is placed on the body portion 52 of the cup member 12.

Figure 6:
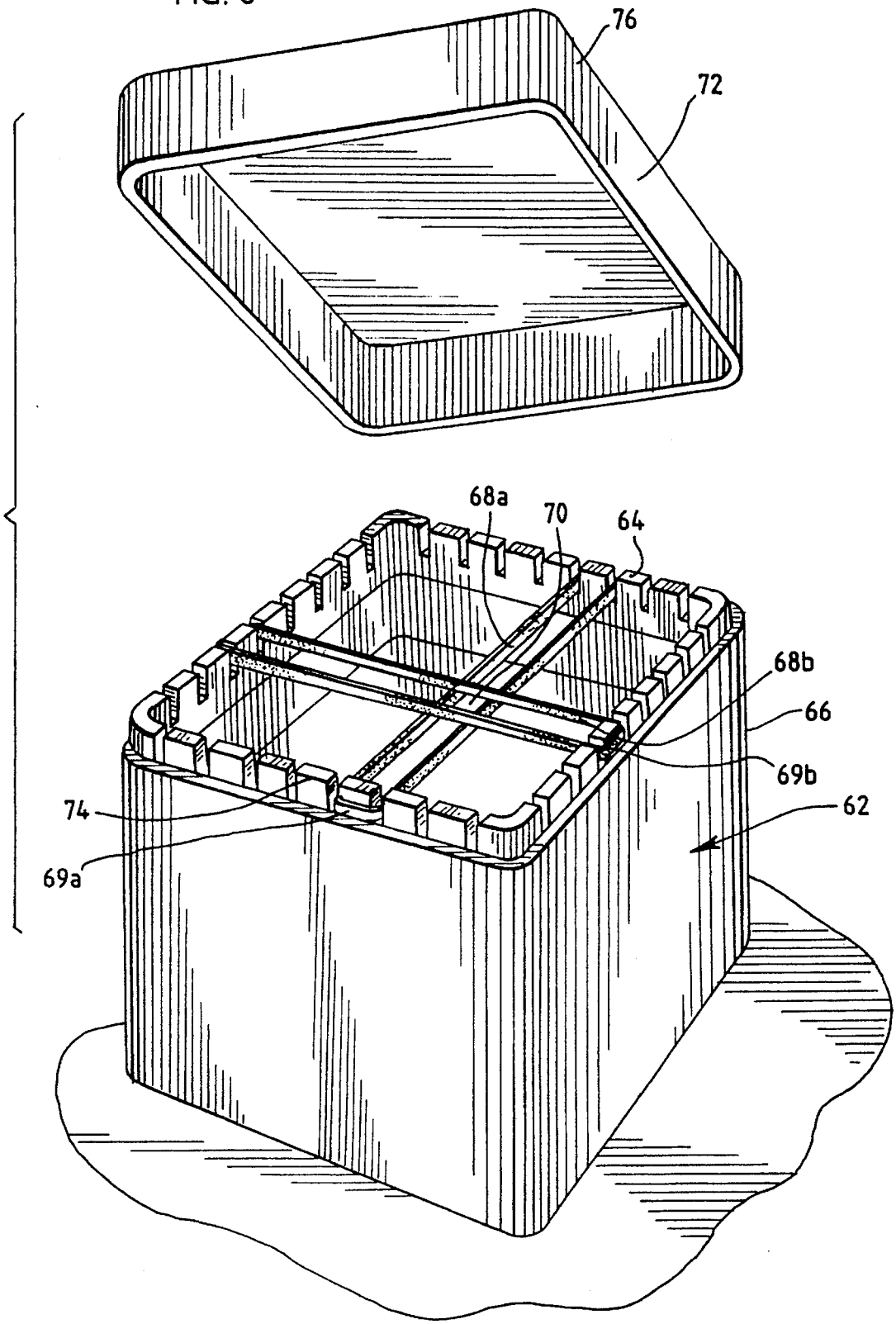
FIG. 6 is an exploded view of an alternative form of the pencil cup component of FIG. 5.

Alternatively, as shown in FIG. 6, a pencil cup member 62 may be constructed very much like the cup member 17 except that the teeth 64 are formed on the body portion 66 of the pencil cup and extend upwardly from the body portion 66 instead of being formed on and depending from a collar portion (compare the collar 44 in FIG. 5, just discussed). Rubber bands 68*a* and 68*b* are looped over the teeth 64 and stretched between them in layers which are preferably closely adjacent, and the rubber bands in each layer are preferably normal to the direction of the rubber bands in the adjacent layer. Although only two rubber bands 68*a* and 68*b* are shown in FIG. 6, they represent the layers of rubber bands strung between all of the teeth 64, and they form a mesh with a plurality of interstices such as the one interstice 70. Thus, the mesh formed on teeth 64 is quite similar to and performs in the same manner as the rubber band mesh of the embodiment first described and shown, for example, in FIG. 3.

The teeth 64 formed on the body portion 66 of the pencil cup member 62 shown in FIG. 6 are dimensioned so that they may, if desired, engage a collar portion 72, either by a friction fit inside the collar portion 72 or by other means. If the teeth 64 are not engaged in a collar, the rubber band mesh may simply fit over the teeth as shown. Also, a rim element (not shown) similar to collar 72 may be made to fit around the teeth and retain the segments 69*a* and 69*b* of the rubber bands looped around the teeth 64 on the teeth. Other mechanical alternatives may be used to keep the looped segments of the rubber bands on the teeth, such as a bead 74 over which a segment of a rubber band may be stretched. However, the collar portion 72 affords an upper edge 76 (as does collar portion 44 see upper edge 78 in FIGS. 3 and 4) which is a convenient means for connecting the pencil cup member 12 with other members of the accessories holder 10, as will next be described.

Figure 2:
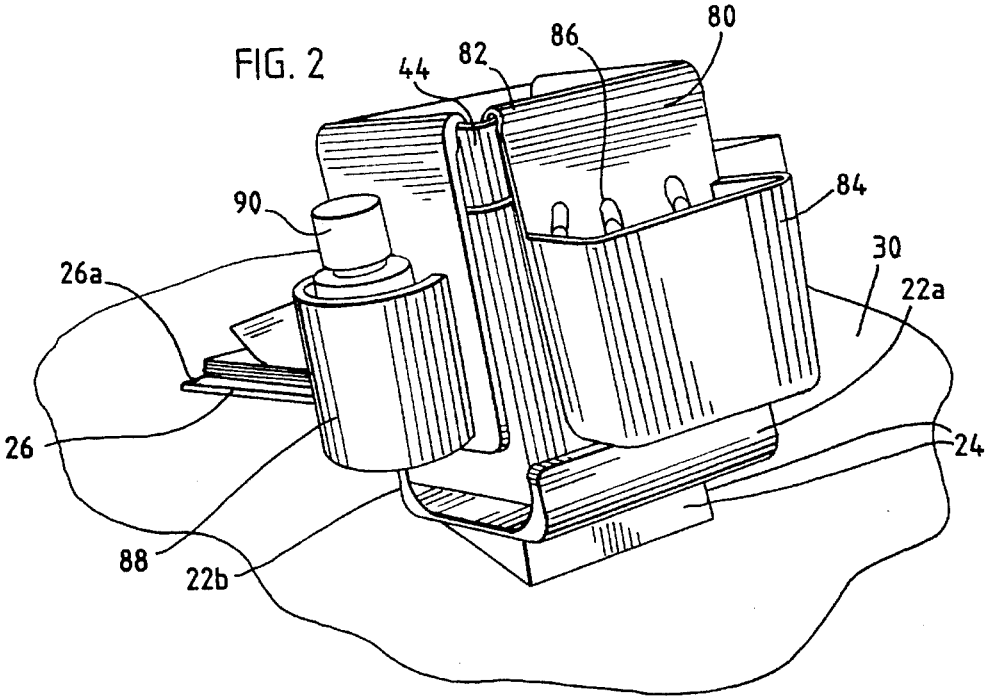
FIG. 2 is a rear perspective view of the desktop accessories holder of FIG. 1 with the hanging component assembled on the rear side of the pencil cup component.

As shown particularly in FIGS. 1 and 2, the pencil cup member 12 supports at least one hanger member 14. The upper edge 78 of the collar 44 is an extension of the sides of the cup and forms an engagement member for one or more hangers. Each hanger 14 includes a sheet portion 80, which is adapted to rest against the outside of the cup member 12, and a lip portion 82 which is adapted to hang onto the edge 78. Basically, the sheet portion 80 is wide and flat in order to match or conformably rest against the side of the pencil cup 12 that it hangs against, although if the body of the pencil cup were more circular, the sheet would be more stable as it hung against the side of the cup in cross section if it were formed in a complimentary shape. Similarly, if there were no appreciable collar 44, the form of the lip 82 might be modified to fit onto the teeth of a pencil cup body such as 66 and dispose the hanger firmly against the shape of the side of the body 66.

On the outside of sheet 80 in the hanger, and facing away from the pencil cup, there may be a variety of attached configurations, such as the pocket 84 for paper clips 86, or pocket 88 for a bottle of typing correction fluid 90, or a box 92 for dispensing stamps in a roll 94. A user facing the desktop on which the accessories holder 10 is resting will be facing a platform and pencil cup tilted toward him, and the hangers mounted on the pencil cup will also be tilted toward him because of their just-described association with the pencil cup member held by the platform member. Any one of the hangers 14 may be accessed while it is disposed on the pencil cup member 12, or alternatively the user can lift it off and remove contents from the pockets 84 or 88 or the box 92 and thereafter replace the selected hanger member onto the edge of the collar 44.

Those skilled in the art will readily see that while numerous detailed variations of the above-described embodiments of this invention may be made, the true scope of the invention is to be determined by the following claims.

I claim:

1. A pencil cup comprising:

a cup body having an upwardly facing open end, a collar portion engaged upon the cup body and forming a mouth of the cup adjacent the open end, and a mesh of rubber bands having edge portions fastened between the collar portion and the cup body and extending across the upwardly facing open end of the cup body.

2. The pencil cup of claim 1 in which the collar portion of the cup includes means for removably affixing the collar portion to the body portion.

3. The pencil cup of claim 2 in which the lower edge portion of the collar portion of the cup includes teeth on which edge portions of the mesh of rubber bands are engaged.

4. The pencil cup of claim 2 in which the upper edge portion of the cup body portion includes teeth on which the collar portion and edge portions of the mesh of rubber bands are engaged.

5. A desktop accessories holder comprising a pencil cup member having an upwardly facing open end for receiving pencils, a collar portion of the cup forming a mouth of the cup adjacent the open end, a body portion of the cup forming a lower closed end of the cup, the collar portion being engaged upon the body portion, a mesh of rubber bands extending across the open end of the cup and having edge portions fastened between the collar and body portions of the cup, and a platform member having upwardly extending edge members engaging the lower closed end of the cup and supporting the cup.

6. The desktop accessories holder of claim 5 which includes a hanger member suspended on a side portion of the cup having a container portion for small office supplies.

7. The desktop accessories holder of claim 6 in which the hanger member includes a lip portion overhanging and disposed upon a portion of an edge of the open end of the cup.

8. The desktop accessories holder of claim 7 in which the hanger member includes a sheet portion connected to the lip portion and resting against the outside of the cup member.

9. The desktop accessories holder of claim 8 in which the side of the sheet portion facing away from the outside of the cup member includes means for dispensing stamps from a roll of stamps.

10. The desktop accessories holder of claim 5 in which the collar portion of the cup includes a lower edge portion which is nestable in the upper edge portion of the cup body portion.

11. The desktop accessories holder of claim 10 in which the lower edge portion of the collar portion of the cup includes teeth on which edge portions of the mesh of rubber bands are engaged.

12. The desktop accessories holder of claim 10 in which the upper edge portion of the cup body portion includes teeth on which the collar portion and edge portions of the mesh of rubber bands are engaged.

* * * * *